US007736583B2

(12) United States Patent
Stanescu et al.

(10) Patent No.: US 7,736,583 B2
(45) Date of Patent: Jun. 15, 2010

(54) GAS CURTAIN ASSEMBY FOR MUFFLED CONTINUOUS FURNACES

(75) Inventors: Mircea Stefan Stanescu, Durham, NC (US); Paul Francis Stratton, Huddersfield (GB)

(73) Assignee: The BOC Group, Inc., Murray Hill, NJ (US)

( * ) Notice: Subject to any disclaimer, the term of this patent is extended or adjusted under 35 U.S.C. 154(b) by 299 days.

(21) Appl. No.: 11/974,066

(22) Filed: Oct. 11, 2007

(65) Prior Publication Data

US 2008/0087204 A1 Apr. 17, 2008

Related U.S. Application Data

(60) Provisional application No. 60/829,163, filed on Oct. 12, 2006.

(51) Int. Cl.
*F23M 11/02* (2006.01)

(52) U.S. Cl. ..... 266/108; 432/250

(58) Field of Classification Search ..... 266/102, 266/103, 108; 432/237, 250
See application file for complete search history.

(56) References Cited

U.S. PATENT DOCUMENTS 3,270,655 A * 9/1966 Guirl et al. ..... 432/247
3,618,919 A * 11/1971 Beck ..... 432/237
4,540,362 A 9/1985 Kurie et al.
5,997,588 A 12/1999 Goodwin et al.

OTHER PUBLICATIONS

M. S. Stanescu, P. F. Stratton, L. Druga, Curtains in Continuous Furnaces, Proceedings of the 24th ASM Heat Treating Society Conference, Sep. 17-19, 2007, pp. 403-418, COBO Center, Detroit, Michigan, USA.

* cited by examiner

*Primary Examiner*—Scott Kastler
(74) *Attorney, Agent, or Firm*—Joshua L. Cohen

(57) ABSTRACT

This invention is directed to a gas curtain assembly which comprises at least one structure of substantially vertical tubes on both sides of and supporting a vertical tube, forming an interconnected frame comprising at least one row of apertures for gas or fluid to pass through and forming a curtain of gas or fluid under the vertical portion of the assembly.

7 Claims, 2 Drawing Sheets

GAS CURTAIN ASSEMBY FOR MUFFLED CONTINUOUS FURNACES

CROSS-REFERENCE TO RELATED APPLICATION

The present application claims priority from U.S. Provisional Patent Application 60/829,163 filed Oct. 12, 2006.

FIELD OF THE INVENTION

The present invention relates to an assembly in a gas curtain assembly, and more particularly, a gas curtain assembly for muffled continuous furnaces.

BACKGROUND OF THE INVENTION

Gas curtains, metal wire mesh, tape or chain curtains, and Refrasil® or other refractory materials are used in continuous furnaces. If the curtain is installed at the charge end opening and discharge end opening, it significantly contributes to reduce air ingress into the furnace, reduce protective atmosphere flow rate and reduce heat losses through the charge and discharge end openings. If the curtain is installed at the beginning of the cooling zone (or in the intermediary zone or at the end of the hot zone), it significantly contributes to reduce heat losses from the hot zone into the cooling zone, separates the atmosphere of the hot zone from that in the cooling zone (which require a higher $H_2/H_20$ ratio at lower temperature to protect against oxidation of metals) and permits a higher cooling rate, shortening the cooling time and the cycle time. In the case of austenitic stainless steels and other materials, cooling from the annealing temperature must be rapid, no more than approximately 3 minutes in cooling from 1600° F. to 800° F. If cooling (zone) does not provide a cooling rate sufficient to prevent carbide precipitation, maximum corrosion resistance will not be obtained.

In the case of the muffled continuous furnaces (including humpback furnaces) installation of the curtain at the beginning of the water cooling zones is very difficult if not impossible. It is therefore desirable in the art for a gas curtain assembly that can be easily inserted into the cooling zone from the discharge end.

SUMMARY OF THE INVENTION

An embodiment of this invention is directed to a gas curtain assembly which comprises at least one structure of substantially vertical tubes on both sides of and supporting a top horizontal gas curtain tube, forming an interconnected frame comprising at least one row of apertures for gas or fluid to pass through and forming a curtain of gas or fluid under the top horizontal gas curtain tube of the assembly.

Another embodiment of this invention is directed to a method of treating a metal object in a gas curtain assembly which comprises at least one structure of substantially vertical tubes on both sides of and supporting a top horizontal gas curtain tube, forming an interconnected frame comprising at least one row of apertures for gas or fluid to pass through and forming a curtain of gas or fluid under the top horizontal gas curtain tube of the assembly, the method comprises passing the metal object through the curtain of gas or fluid under the top horizontal gas curtain tube.

BRIEF DESCRIPTION OF THE DRAWINGS

While the specification concludes with claims distinctly pointing the subject matter that applicant regard as their invention, it is believed that the invention would be better understood when taken in connection with the accompanying drawings in which

DETAILED DESCRIPTION OF PREFERRED EMBODIMENTS

The present invention is directed to a gas curtain assembly that can be easily inserted into the cooling zone from the discharge end.

In one embodiment, the gas curtain assembly will be used in a muffled continuous furnaces (including humpback furnaces) using a plurality of gases including $N_2$ and $H_2$, Ar and He, or substantially pure $H_2$. In certain embodiments, the gas or fluid comprises a cryogen.

Figure 1:
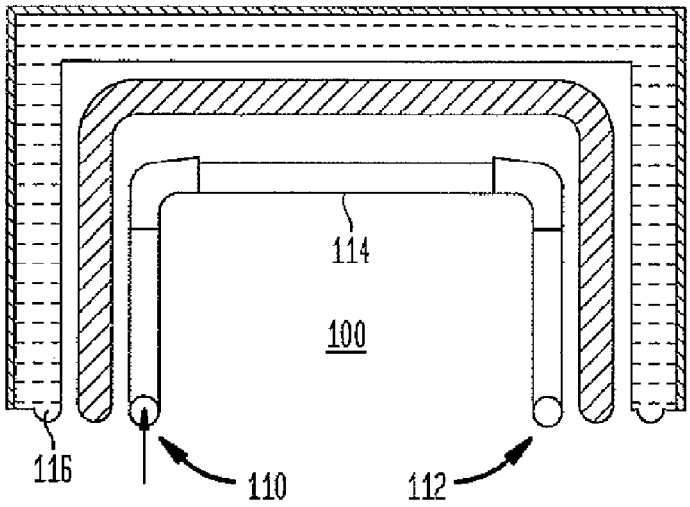
FIGS. 1 to 5 are various aspects of gas curtain assembly for muffled continuous furnaces as embodied in this invention.
Figure 2:
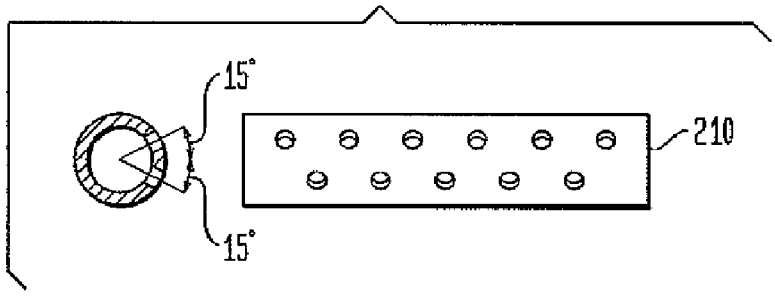
Figure 3:
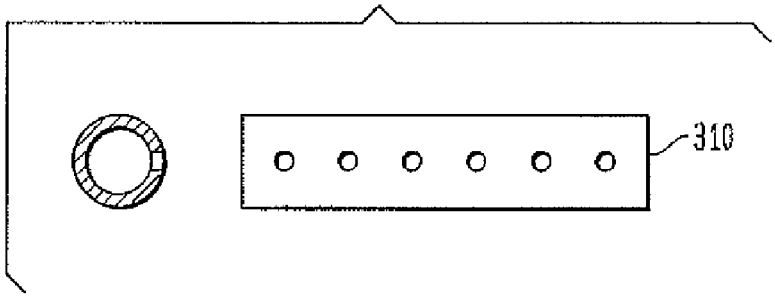

In FIG. 1, the gas curtain assembly 100 of this invention is inserted into the cooling zone, from the discharge end. This gas curtain is easy to install and could work even if the moving parts have different heights. The gas may be any cooling gas. In one embodiment, the cooling gas is nitrogen. The gas is introduced through the left tube 110 in FIG. 1. It could be introduced through both left tube 110 and right tube 112, if necessary. The gas curtain, which acts like a gas injection tube, could have one row of holes 310 in FIG. 3, or two rows of holes 210 in FIG. 2. Other rows of holes are possible and are also contemplated by this invention. The gas comes out from these holes are perpendicular (or almost perpendicular) to the moving belt. These output gas flow forms a curtain. Always, if the gas output is not exactly perpendicular, the movement of the gas should be in direction of discharge end of the furnace, to keep air out.

Figure 4:
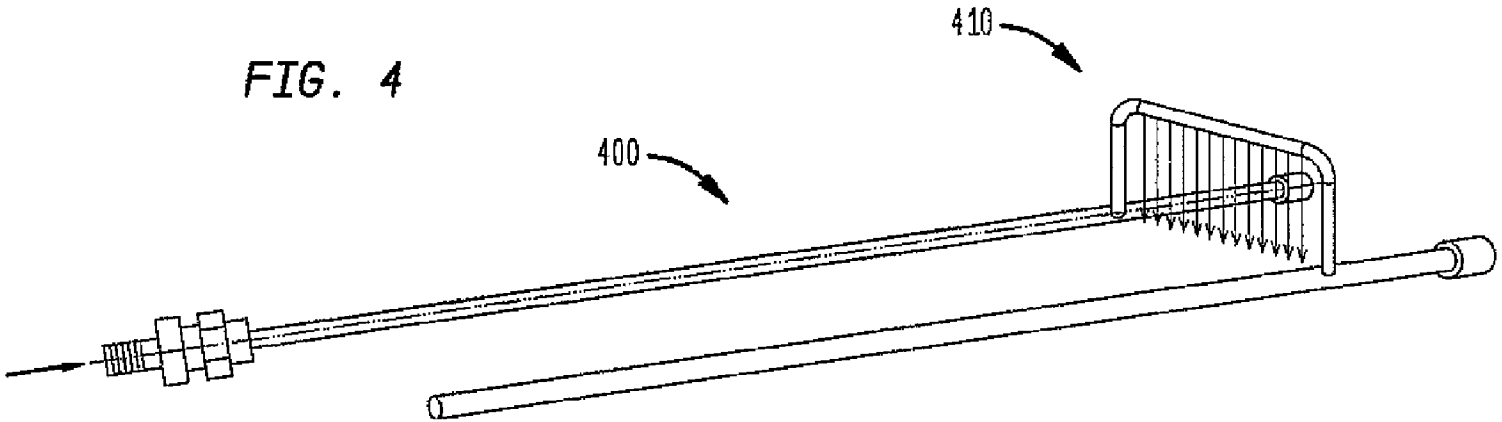

An alternate gas-tape (or wire mesh) Refrasil® cordage (or tape) curtain assembly is shown in FIG. 4 for moving parts having about the same height. In this assembly, the gas curtain is in between the tape (or wire mesh) curtain and the Refrasil® cordage (or tape) curtain. In one embodiment, the tape (or wire mesh) curtain being made of a refractory alloy, is installed on the hot side of the curtain assembly.

In an embodiment, the gas curtain assembly of this invention reduces consumption of fuel (ex: natural gas) used for heating the furnace by 10%-20%, in addition to using curtains at the charge and discharge ends.

In an embodiment, the gas curtain assembly of this invention reduces consumption of the gas(es) used for the atmosphere by 10%-20% in addition to using curtains at the charge and discharge ends.

In an embodiment, the gas curtain assembly of this invention contributes to reducing the cooling time.

In an embodiment, the gas curtain assembly of this invention may be produced and fitted in various different configurations. This gas curtain is easy to build, install and could work even if the moving parts have different heights. It could be installed when the muffle design of the continuous furnace makes difficult if not impossible to install any other curtain.

In an embodiment, the gas curtain assembly of this invention comprises an injection tube device could be used as an inlet for the atmosphere. The gas passing through the small holes has a high velocity. This velocity gives directionality to the gas and in controlling the direction of the gas flow, by slightly inclining the assembly, a couple of grades.

In an embodiment, the gas curtain assembly of this invention may contribute to a higher rate of cooling by significantly reducing heat losses from hot zone into the cooling zone (Note: In the case of austenitic stainless steels and other materials, cooling from the annealing temperature may be rapid, no more than approximately 3 minutes in cooling from 1600° F. to 800° F.).

Figure 5:
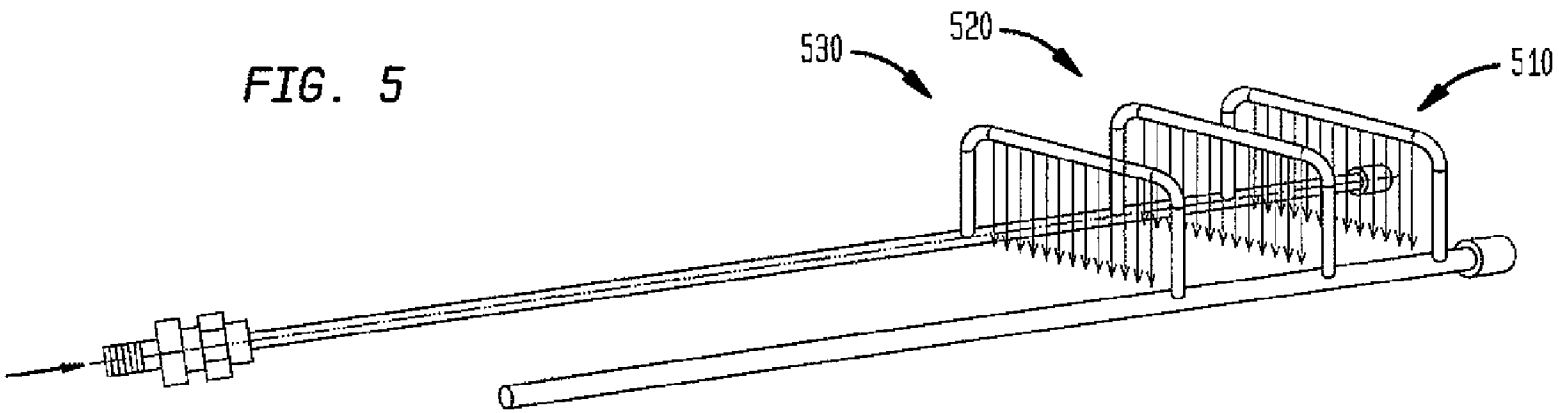

In an embodiment, the gas curtain assembly may also have an alternate (or second version) gas-tape (or wire mesh)-Refrasil® cordage (or tape) curtain assembly in FIG. 5 with the gas curtain located between the tape (or wire mesh) curtain and the Refrasil® cordage (or tape) curtain present the advantage of a higher rate of cooling than the first version of gas curtain assembly (which has only a gas curtain) in FIG. 4.

It will be understood that the embodiment(s) described herein are merely exemplary, and that one skilled in the art may make variations and modifications without departing from the spirit and scope of the invention. All such variations and modifications are intended to be included within the scope of the invention as described hereinabove. Further, all embodiments disclosed are not necessarily in the alternative, as various embodiments of the invention may be combined to provide the desired result.

What is claimed is:

1. A gas curtain assembly adapted to be inserted into a continuous furnace from the discharge end of the continuous furnace, which comprises at least one structure of substantially vertical tubes on both sides of and supporting a top horizontal gas curtain tube, forming an interconnected frame comprising at least one row of apertures for gas or fluid to pass through and forming a curtain of gas or fluid under the top horizontal gas curtain tube of the assembly, wherein the vertical tubes are engaged with base horizontal tubes which extend longitudinally inside the continuous furnace, and wherein the base horizontal tubes are substantially transverse to the plane of the gas curtain assembly.

2. The gas curtain assembly of claim 1 wherein the gas curtain assembly is adapted such that the gas or fluid passing through the at least one row of apertures comprises a cryogen.

3. The gas curtain assembly of claim 1 wherein at least one of the base horizontal tubes provides an inlet for the gas or fluid.

4. The gas curtain assembly of claim 1 wherein the gas curtain assembly is adapted to treat a metal object under the top horizontal gas curtain.

5. A method of treating a metal object in a gas curtain assembly adapted to be inserted into a continuous furnace from the discharge end of the continuous furnace, which gas curtain assembly comprises at least one structure of substantially vertical tubes on both sides of and supporting a top horizontal gas curtain tube, forming an interconnected frame comprising at least one row of apertures for gas or fluid to pass through and forming a curtain of gas or fluid under the top horizontal gas curtain tube of the assembly, wherein the vertical tubes are engaged with base horizontal tubes which extend longitudinally inside the continuous furnace, and wherein the base horizontal tubes are substantially transverse to the plane of the gas curtain assembly the method comprising supplying the gas or fluid to the at least one row of apertures through at least one of the base horizontal tubes, at least one of the vertical tubes, and the top horizontal gas curtain tube, and passing the metal object through the curtain of gas or fluid under the top horizontal gas curtain tube.

6. The method of claim 5 wherein the gas or fluid comprises a cryogen.

7. The method of claim 5 wherein at least one of the base horizontal tubes provides an inlet for the gas or fluid.

* * * * *

UNITED STATES PATENT AND TRADEMARK OFFICE

CERTIFICATE OF CORRECTION

PATENT NO. : 7,736,583 B2
APPLICATION NO. : 11/974066
DATED : June 15, 2010
INVENTOR(S) : Mircea Stefan Stanescu and Paul Francis Stratton It is certified that error appears in the above-identified patent and that said Letters Patent is hereby corrected as shown below:

On the Title page,

At the masthead page with the Abstract, item (54), change "Assemby" to be -- Assembly --.

Column 1, line 1, change "Assemby" to be -- Assembly --.

Signed and Sealed this

Twenty-seventh Day of July, 2010

David J. Kappos

David J. Kappos
*Director of the United States Patent and Trademark Office*